US009062526B2

(12) United States Patent
Di Renzo et al.

(10) Patent No.: US 9,062,526 B2
(45) Date of Patent: Jun. 23, 2015

(54) AUTOMATIC MODULAR MAINTENANCE DEVICE OPERATING IN THE ANNULUS OF A WELL FOR THE PRODUCTION OF HYDROCARBONS

(75) Inventors: Domenico Di Renzo, Casirate d'Adda (IT); Roberto Finotello, Venice (IT)

(73) Assignee: ENI S.p.A., Rome (IT)

( * ) Notice: Subject to any disclaimer, the term of this patent is extended or adjusted under 35 U.S.C. 154(b) by 337 days.

(21) Appl. No.: 13/518,568

(22) PCT Filed: Dec. 16, 2010

(86) PCT No.: PCT/IB2010/003299

§ 371 (c)(1),
(2), (4) Date: Sep. 26, 2012

(87) PCT Pub. No.: WO2011/077218

PCT Pub. Date: Jun. 30, 2011

(65) Prior Publication Data

US 2013/0014932 A1 Jan. 17, 2013

(30) Foreign Application Priority Data

Dec. 22, 2009 (IT) ..... MI2009A 002262

(51) Int. Cl.
*E21B 47/01* (2012.01)
*E21B 23/00* (2006.01)

(52) U.S. Cl.
CPC ..... *E21B 47/01* (2013.01); *E21B 23/00* (2013.01)

(58) Field of Classification Search
CPC ..... E21B 47/01; E21B 23/00; E21B 33/04; E21B 34/006; E21B 34/06; E21B 41/0085; E21B 41/00; F03B 13/10; H02K 35/00; H02P 9/00
USPC ..... 166/53, 66, 54, 65.1; 290/1 R, 54
See application file for complete search history.

(56) References Cited

U.S. PATENT DOCUMENTS

| | | | | |
|---|---|---|---|---|
| 3,937,278 | A | 2/1976 | Sheshtawy | |
| 5,396,966 | A | 3/1995 | Roos, Jr. et al. | |
| 6,454,011 | B1 | 9/2002 | Schempf et al. | |
| 6,462,672 | B1 | 10/2002 | Besson | |
| 6,766,703 | B1 | 7/2004 | Kluth et al. | |
| 2002/0096322 | A1 | 7/2002 | Barrett et al. | |
| 2003/0029618 | A1 | 2/2003 | Schempf et al. | |
| 2003/0098799 | A1 | 5/2003 | Zimmerman | |
| 2003/0159823 | A1 | 8/2003 | Pichery et al. | |
| 2008/0042869 | A1 | 2/2008 | Zimmerman | |
| 2011/0049901 | A1 * | 3/2011 | Tinnen et al. | 290/54 |

OTHER PUBLICATIONS

International Search Report Issued Dec. 6, 2011 in PCT/IB10/03299 Filed Dec. 16, 2010.

* cited by examiner

*Primary Examiner* — Yong-Suk (Philip) Ro
(74) *Attorney, Agent, or Firm* — Oblon, McClelland, Maier & Neustadt, L.L.P.

(57) ABSTRACT

An automatic modular maintenance device operating in an annulus of a well for the production of hydrocarbons, which includes a plurality of modules having a substantially cylindrical portion and connected to each other by means of articulated joints, and is configured to float in a completion fluid present in the annulus of the well.

14 Claims, 12 Drawing Sheets

AUTOMATIC MODULAR MAINTENANCE DEVICE OPERATING IN THE ANNULUS OF A WELL FOR THE PRODUCTION OF HYDROCARBONS

SUMMARY

The present invention relates to an automatic modular maintenance device operating in the annulus of a well for the production of hydrocarbons.

More specifically, the present invention relates to an automatic modular maintenance device operating in the annulus of a well for the extraction of oil or gas, vertical or with limited deviation, both onshore and offshore.

Even more specifically, the present invention relates to an automatic device or robot designed for operating in the annular space situated between the production casing and tubing and delimited, in the lower part, by the packer, to allow the maintenance and/or substitution and/or operation of sensors and valves, known as service elements or components, specifically designed. In particular, the automatic device object of the present invention is capable of moving autonomously within the annulus, also clamped to the outer surface of the tubing, and reaching service elements installed along the outer surface of the tubing, along the inner surface of the casing, or simply installed over the upper part of the packer, in order to effect, for example, substitution and/or maintenance operations of said service elements.

BACKGROUND

Figure 1:
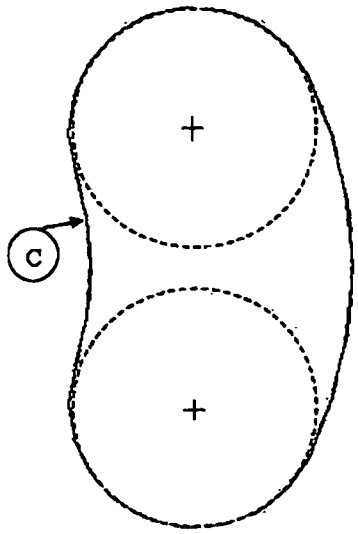
FIG. 1 represents a cross section of a generic module C.

As is known, during the construction of a well for the production of hydrocarbons, the continuous reinforcement of its walls, during the deepening of the well, is necessary for preventing it from collapsing. The reinforcing structure, called "casing", substantially consists of a metallic cylindrical body inserted in the cavity and adhered to the walls of the well by means of cement.

When the well starts production, the oil is recovered by means of a specific tube, known as a production tube or "tubing". This is a steel pipe which is inserted in the well until it reaches the level of the reservoir. The tubing is held at the well bottom by means of a system having a combined hydraulic and mechanical seal—called "packer"—which forces the oil to rise to the surface inside the tubing, without touching the walls of the casing.

During the lifetime of the well, the tubing and casing are kept under control by means of a set of service elements, for example, pressure sensors, temperature sensors, plugs, flow valves, data communication control units, etc, which are installed during the construction of the well. These service elements, suitably designed, are positioned, for example, in the annulus, on the outer surface of the tubing. However, as, in order to equalize the pressure exerted at the well bottom by the reservoir, the annulus is filled with a liquid, known as completion liquid, with a density ranging from 1.1 to 1.8 kg/l, the maintenance and/or substitution operation of said service elements present in the annulus, is not easy to effect. The completion liquid normally consists of an aqueous solution of inorganic salts.

DETAILED DESCRIPTION OF THE EMBODIMENTS

With respect to the technologies currently available, the present device represents a true innovation as it allows the maintenance operations of the service components present in the annulus to be effected, also autonomously, avoiding the drawbacks described hereunder.

Current technologies for monitoring and operations on the tubing during the lifetime of a well, use the traditional "wireline" operations, in which the maintenance system is lowered inside the tubing, wherein it is maintained and driven by means of a cable. This requires the temporary suspension of the well production.

Traditional intervention methods are also exposed to risks linked to the presence of deposits of waxes and paraffins, in addition to hard builtup, along the tubing, which can partially obstruct the passage area and jeopardize the success of the operations.

In recent years, the attainment of a suitable instrumentation for wells has become an increasingly important requirement for a better monitoring and control of the wells and an optimized management of the reservoir. The new technologies so far developed for this purpose (intelligent service elements, flow-rate meters and well bottom P/T sensors, etc.) do not satisfy the fundamental requirement of reliability, to guarantee availability of these service elements operating for many years under well-bottom conditions.

This criticality is solved by the device object of the present invention, which provides the possibility of controlling, effecting the maintenance and, if necessary, substituting the service components installed in annulus, between the casing and the tubing, without interrupting well production. With respect to currently available technologies, this leads to easier, faster and more economical recovery of the functionality of the well in case of breakdowns and, above all, it guarantees the performance of the service components during the entire life cycle of the well.

Reliability of service components in well is extremely important for Oil Companies: various initiatives have been taken for solving this problem. None of these however has ever considered the possibility of controlling, effecting maintenance and, possibly, substituting the service components through the annulus during the operative phase of the well itself, without interrupting the production.

Therefore, object of the present invention, better described in the enclosed claims, relates to an automatic modular maintenance device operating in the annulus of a well for the production of hydrocarbons, said annulus consisting of the annular space between the production casing and tubing and delimited at the bottom by the packer, to allow the maintenance and/or substitution, and/or operation of the service components suitably designed for interacting with the present device.

The device object of the present invention is used during the production phase of the well, as it is capable of floating and reaching the operating position by moving, substantially automatically, in the completion fluid and does not necessarily require any physical connection with the surface, as it is capable of being completely autonomous. The device, indeed, is capable of providing its own propulsion and power supply, autonomously floating in the completion fluid to reach the operating positions at the above mentioned elements and transporting the maintenance instruments and the elements to be substituted in the well.

In particular, the automatic modular maintenance device operating in the annulus of a well for the production of hydrocarbons, object of the present invention, is capable of:

a. moving, also autonomously, in the completion fluid between the casing and the tubing, effecting planned missions;
b. identifying and reaching service stations, previously prepared along the tubing, corresponding to the service components to be controlled/substituted/subjected to maintenance;
c. clamping itself to said service stations;
d. effecting maintenance and/or substitution operations of the service elements situated along the tubing or, possibly, along the casing;
e. effecting maintenance and substitution operations of the service elements situated above the packer of the well bottom;
f. returning, even in emergency case, by rising back to the well head.

The device is characterized by a modular architecture. This architecture allows the robot configuration to be adapted to the "mission" to be effected and, in general, to provide a greater operational and maintenance flexibility. In particular the device includes at least eight modules, having a substantially cylindrical form and essentially elliptical cross section, in which the larger axis of the ellipse is curved so as to be substantially parallel to the circumferences of the casing and tubing (bilobate form of the cross section). In this way, each module of the present device is characterized by a concave surface, which faces the tubing, and a convex surface, which faces the wall of the casing. This cross section, illustrated in FIG. 1, allows the morphology of the passage area in the annulus to be exploited as much as possible, passively maintaining the centrality of the vehicle with respect to that.

On the outer surface of at least the first module, both concave part and convex part, there are a set of seats suitable for housing a set of sliding balls, free to rotate, which act both as dampers for possible impacts of the module against the walls, and as bearings to facilitate the vertical translation of the robot in the completion fluid.

Each module is connected with the adjacent modules by means of articulated joints, in order to avoid undesired stiffness. Power supply lines and communication lines, for command/control signals of each module, pass through the joints.

Each module has a specific function. The reference configuration, better illustrated hereunder with reference to the attached figures, allows the substitution/maintenance of a certain number of service components positioned on the tubing and/or casing along the trajectory of the robot, and also of a component such as, for example, the battery pack for power supply of said components, generally positioned at the well bottom.

The automatic maintenance device operating in the annulus of a well for the production of hydrocarbons will be better described with reference to the drawings of the attached figures which represent a general embodiment. With reference to the figures:

FIG. 1 represents a cross section of a generic module C where the sections of two possible housings (with hermetic sealing) for the service elements which are transported/recovered from the module itself, are shown by means of the dashed line.

Figure 2:
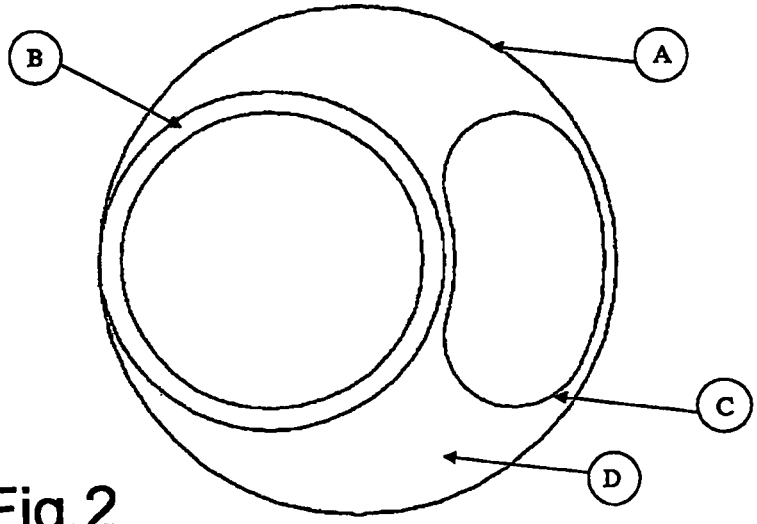
FIG. 2 represents a cross section of the operative well in which the device, object of the present invention is inserted.

FIG. 2 represents a cross section of the operative well in which the device, object of the present invention is inserted. A represents the section of the casing, B represents the section of the tubing whereas C is the section of the robot in correspondence with a generic module and D represents the annulus. As it can be observed, the tubing is not concentric with respect to the casing but is offset so as to be adjacent, or close, to the internal wall of that. This allows the robot to be inserted in the area of the annulus having the greatest width so that the concave and convex walls can slide, by means of the sliding balls, against the outer wall of the tubing and internal wall of the casing, respectively. This arrangement allows the robot to avoid side shifts and to move, in this case by exploiting floating mechanisms in the completion fluid, described hereunder, only vertically, downwards or upwards.

Figure 3:
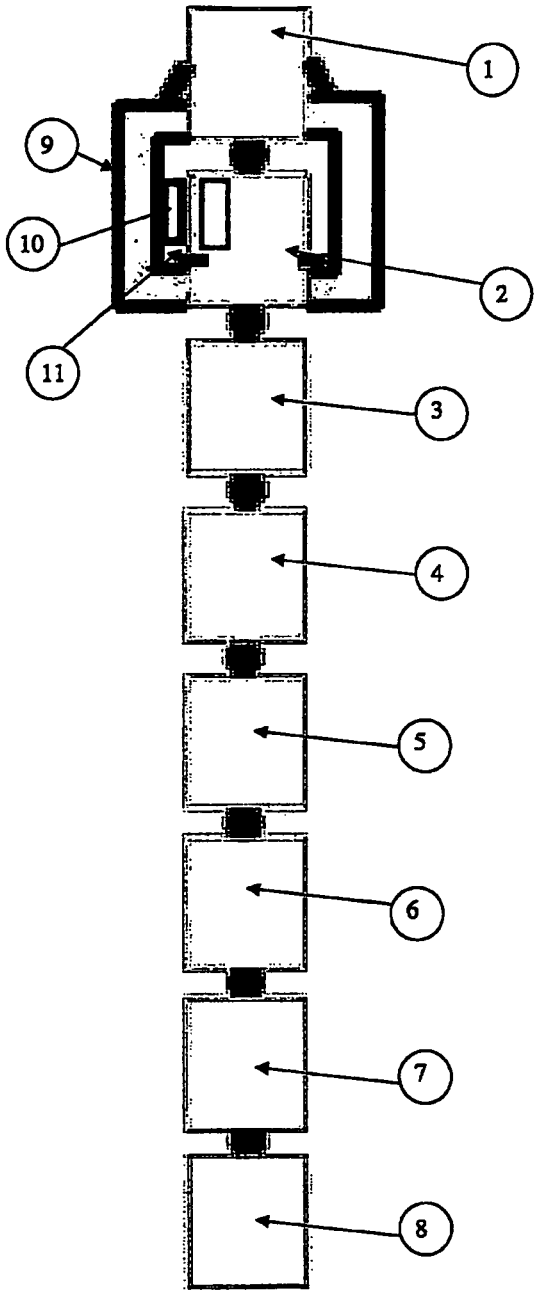
FIG. 3 represents a front schematic view of the automatic device object of the present invention.

FIG. 3 represents a front schematic view of the automatic device object of the present invention, comprising 8 modules (references from 1 to 8) connected to each other by means of articulated joints (dark circles between modules). The device is represented anchored to one of the service stations (9) present inside the well in correspondence with the sensors (10) or other service components.

Figure 4:
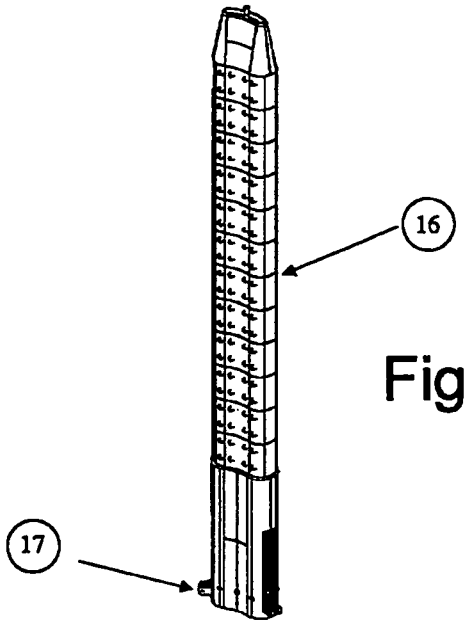
FIG. 4 represents a three-dimensional view of the module "Upper head."

FIG. 4 represents a three-dimensional view of the module "Upper head" (1). This module is used to execute the stop of the robot, by means of an anchoring mechanism, at a "service station" (9), for the substitution of a sensor (10) which is effected by means of the module (2). This mechanism is activated by a specific motor and allows the extension of two arms (17) designed so as to be engaged, with a vertical downward movement of the vehicle, in the specific interfaces (11) present in the service station.

The upper part of the module (16) consists of floating foams to balance its weight in the completion fluid. On the lateral surface, both on concave one and on convex one, there are seats to house free rotating balls suitable for reducing the scraping on tubing and casing and thus minimizing the energy consumption due to friction during the movement. Furthermore, a rotating eccentric mass is arranged inside the module, which creates a vibration useful for avoiding wedging during the re-entry of the vehicle.

Figure 5:
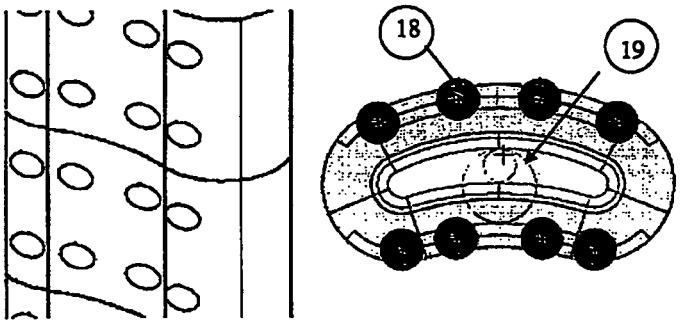
FIG. 5 shows the details relating to the sliding balls and the eccentric rotating mass.

FIG. 5 shows the details relating to the sliding balls (18) and the eccentric rotating mass (19).

Figure 6:
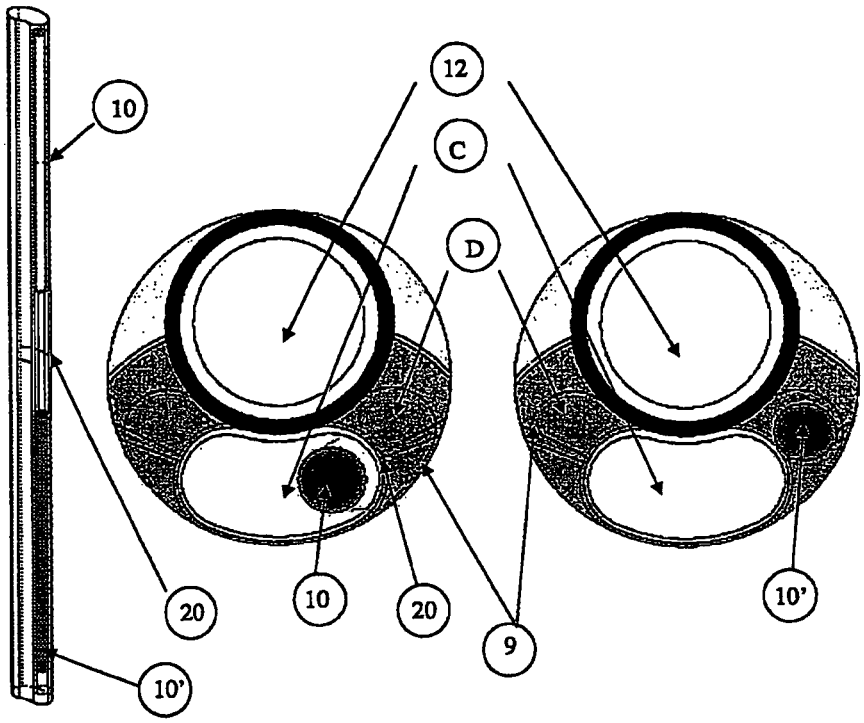
FIG. 6 shows a three-dimensional view of the module "Substitution of Service Elements" and two views of the cross section of the well at the height of this module inside the annulus D, the first with the service element to be substituted in its seat, before insertion, the second with the recovered sensor inserted in another seat.

FIG. 6 shows a three-dimensional view of the module "Substitution of Service Elements" (2) and two views of the cross section of the well at the height of this module inside the annulus D, the first with the service element (a sensor, for example) to be substituted in its seat, before insertion, the second with the recovered sensor (10') inserted in another seat. In particular, the module (2) comprises at least three stacked vertical seats. One of the three seats allows the transporting of the new sensor (10). The second one, the containment of that to be substituted (10'). The third one, between the two previous seats, allows the exchange of two sensors by means of the opening (20) dedicated to the passage of the sensor. This module is also provided with a clamping mechanism to the service station and a system for effecting the substitution operations of the sensors, not illustrated in the figure. The clamping mechanism is necessary in the substitution phase in order to apply the force necessary for performing the extraction/insertion operation of the sensor.

The substitution system consists of a combination of mechanisms for the collection and storage of the sensor to be substituted and for the positioning of the new sensor.

Figure 7:
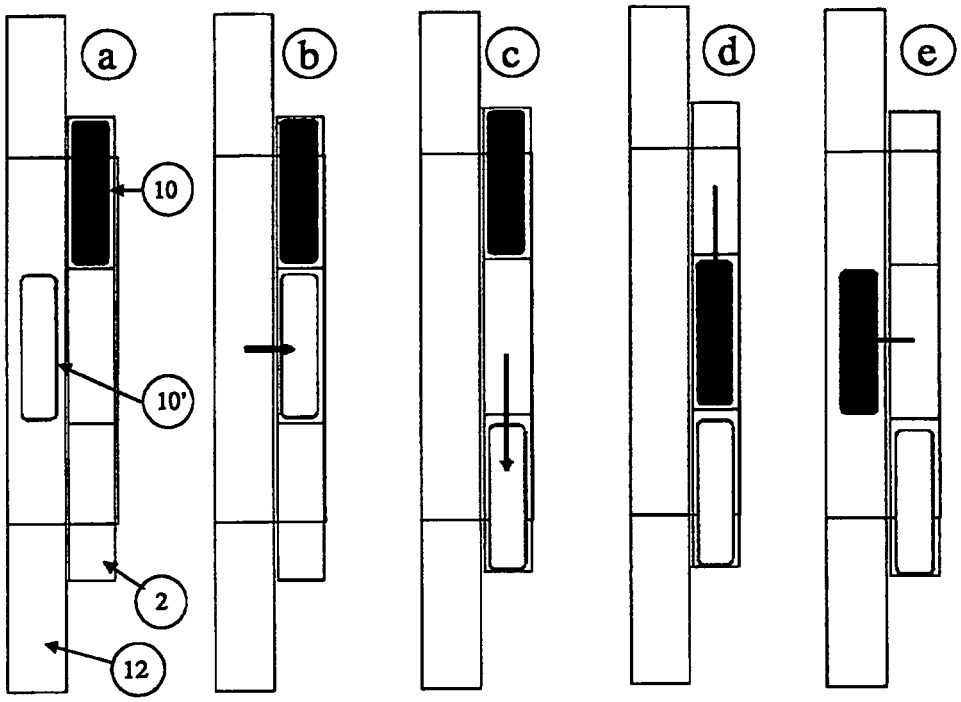
FIG. 7 illustrates the operative scheme of the installation phases of a new sensor.

FIG. 7 illustrates the operative scheme of the installation phases of a new sensor:

a. Clamping of the module (2) to the service station;

b. Collection of the non-functioning sensor (10');

c. Storage of the malfunctioning sensor (10');

d. Preparation of the new sensor (10) for assembly;

e. Positioning of the new sensor on the tubing.

Figure 8:
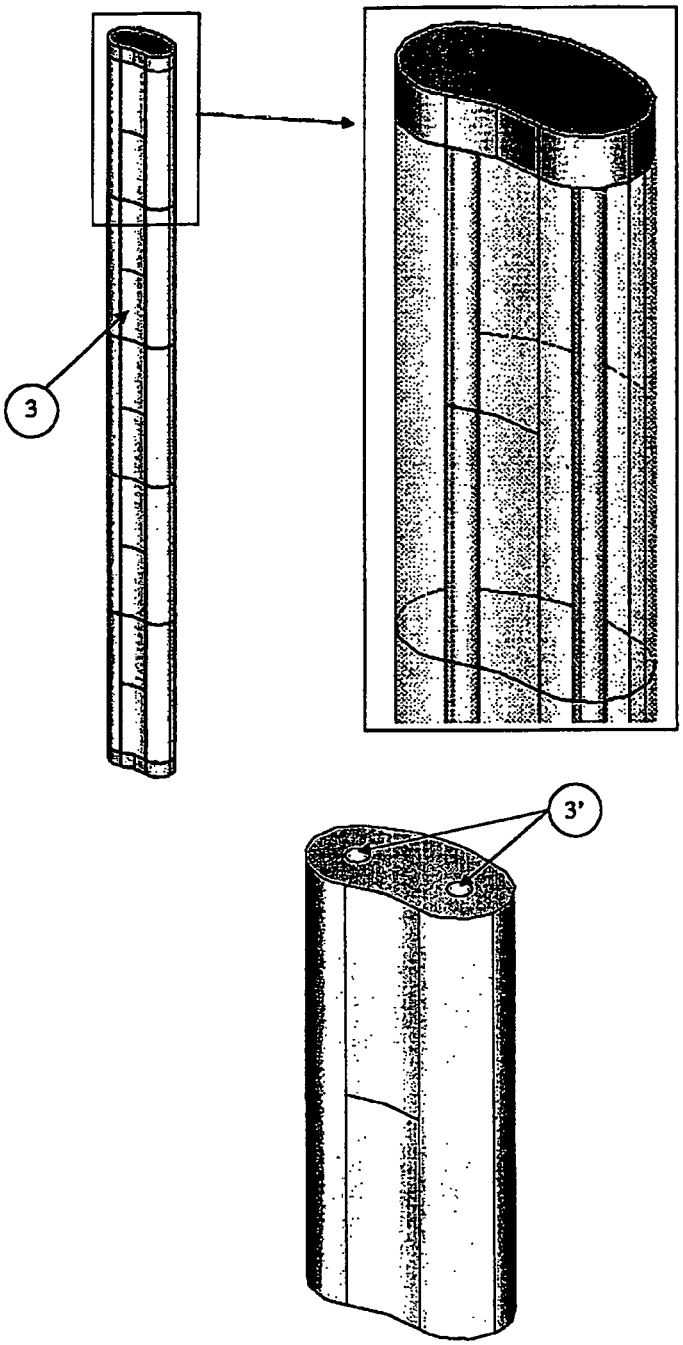
FIG. 8 illustrates the "foam" module with a three-dimensional view.

FIG. 8 illustrates the "foam" module (3) with a three-dimensional view. That module is used to make the vehicle neutral (not moving) at the mission start. Even if each module has foams onboard, in order to compensate its weight in the completion fluid, it is in any case necessary to envisage at least one module dedicated to this function, also for regulating the thrust in relation to the density of the completion fluid in which the robot will operate.

The module includes two or more bodies of rigid commercial foams, with a low density (lower than that of the completion liquid), for example, from 2 to 8 elements, produced with materials capable of operating at high pressures, for example rigid polyurethane foams, whose bodies are characterized by a length of about 200 mm, bilobate form, and two pass-through holes (3') for the passage of supports which keep the single bodies together.

Figure 9:
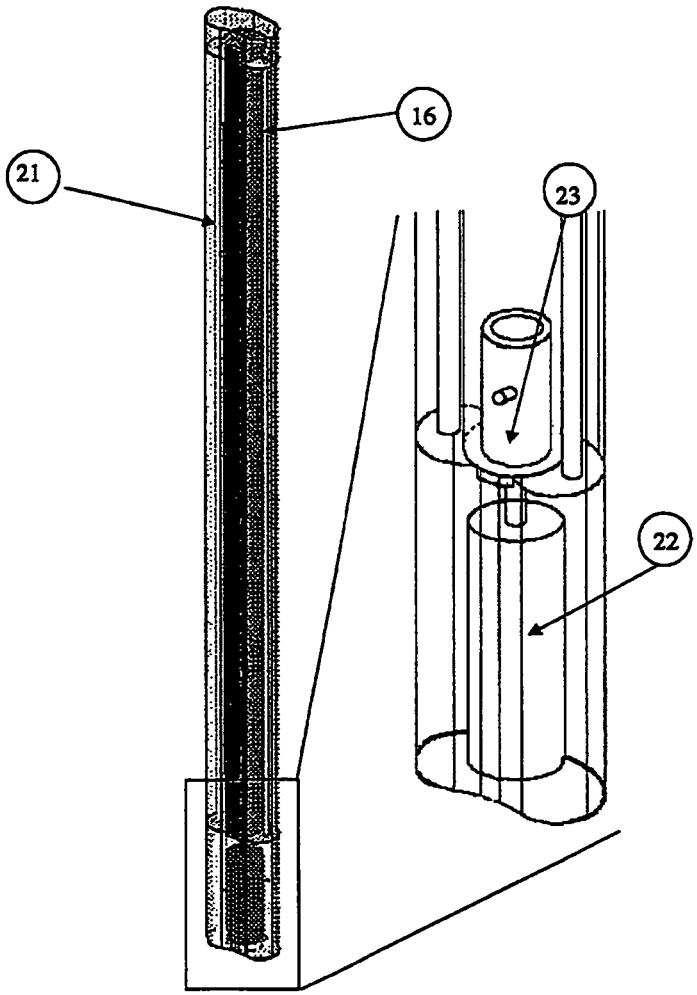
FIG. 9 illustrates the "Controlled Thrust" module.

FIG. 9 illustrates the "Controlled Thrust" module (4). This module allows the control of the thrust movement of the vehicle along the annulus. It allows a volume of a compressible gas, for example nitrogen, to be varied through the introduction of the completion fluid into a sealed tank (21) enveloped by foam elements (16). In this way, it is possible to compress or expand the volume of nitrogen in order to reduce or increase the floating thrust.

The nitrogen is inserted in the tank at a relatively low pressure: in this way it is possible to always passively introduce the completion fluid into the tank ($p_{external} > p_{internal}$). A pump (23), driven by a motor (22), is activated in order to expel the completion fluid, when it is necessary to increase again the floating thrust.

Figure 10:
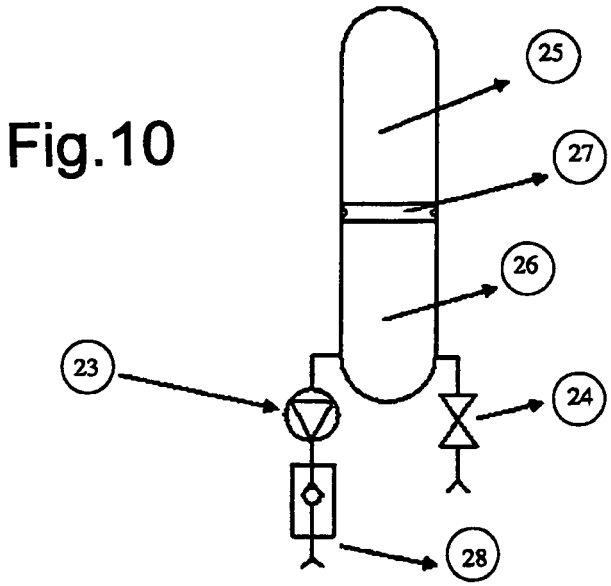
FIG. 10 schematically illustrates the circuit for running the controlled thrust operative phase.

FIG. 10 schematically illustrates the circuit for running the controlled thrust operative phase. In the case of downward movement of the device, object of the present invention, the valve (24) is opened for the passive introduction of liquid within the volume (26) compressing the nitrogen contained in the volume (25), by means of the moveable sealing septum (27). In the case of upward movement, the power necessary for expelling the liquid contained in the volume (26) is obtained by means of the pump (23). The reference (28) indicates a valve control device.

Figure 11:
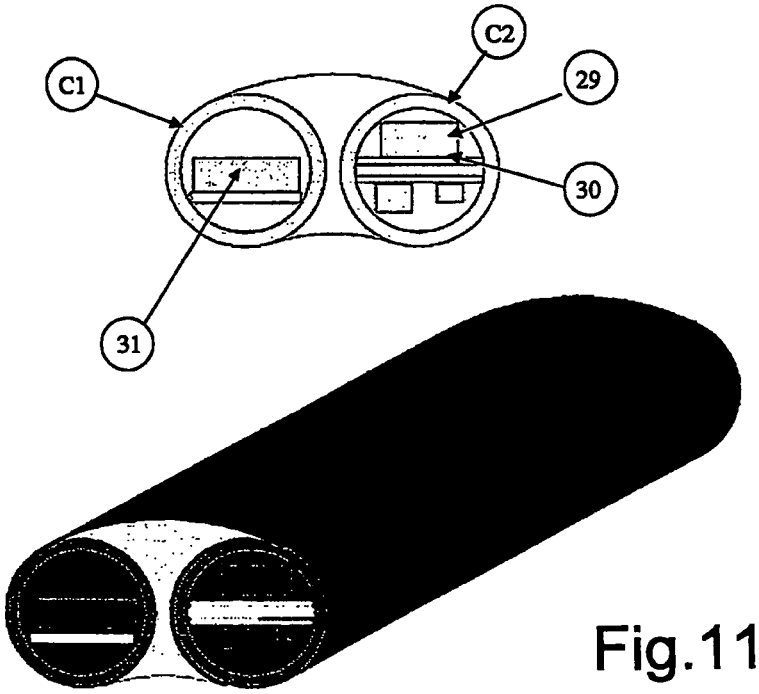
FIG. 11 illustrates the "Control" module.

FIG. 11 illustrates the "Control" module (5). This module contains the electronics for regulating the floating of the robot in the completion fluid (towards the top or bottom of the well), for example a control electronic board (29), a driving board (30) and a power supply board (31), and the sensors for measuring the pressure and temperature of the external environment. All the electronics is situated inside the sealed containers C1 and C2.

Figure 12:
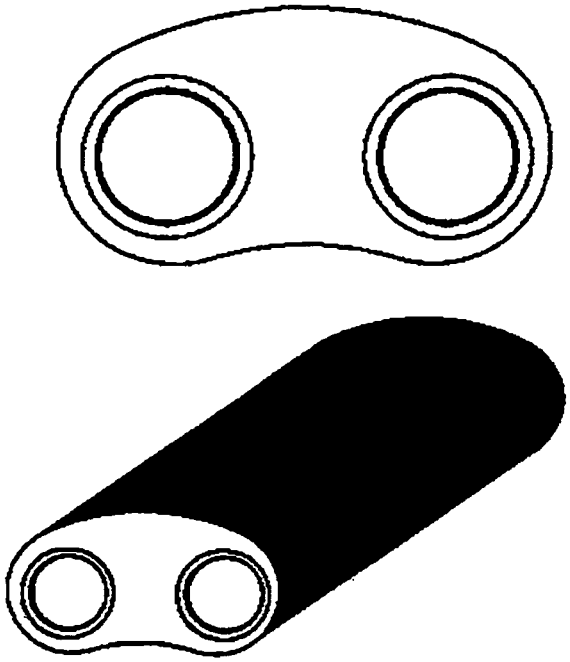
FIG. 12 illustrates the "Battery" module and also one of its cross sections.

FIG. 12 illustrates the "Battery" module (6) and also one of its cross sections. This module transports the sealed containers of the batteries used for power the robot during the whole mission and during management of possible emergencies. When the batteries are exhausted, they can be replaced by bringing the device back to the surface. Alternatively, power supply points can be positioned on the casing to recharge the batteries.

Figure 13:
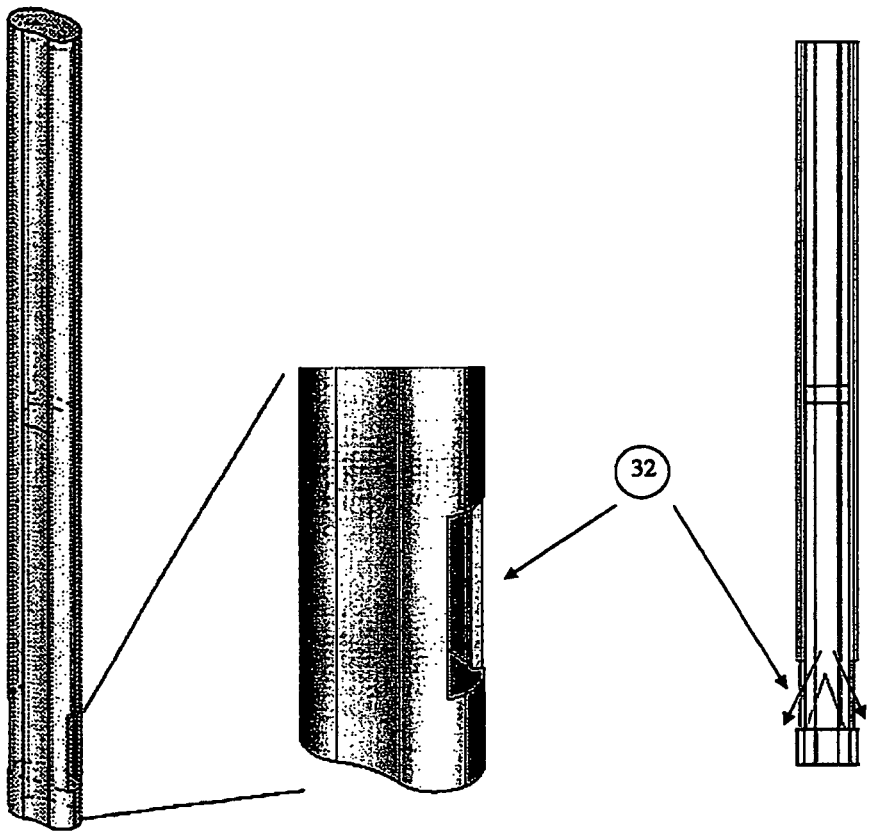
FIG. 13 illustrates the "Ballast" module.

FIG. 13 illustrates the "Ballast" module (7). This module guarantees the re-ascent of the vehicle in the case of emergencies and/or breakdown of the system. In the case of an emergency, a heavy substance is released, preferably soluble in the completion fluid, through an opening (32), which allows the passive re-ascent of the system.

Figure 14:
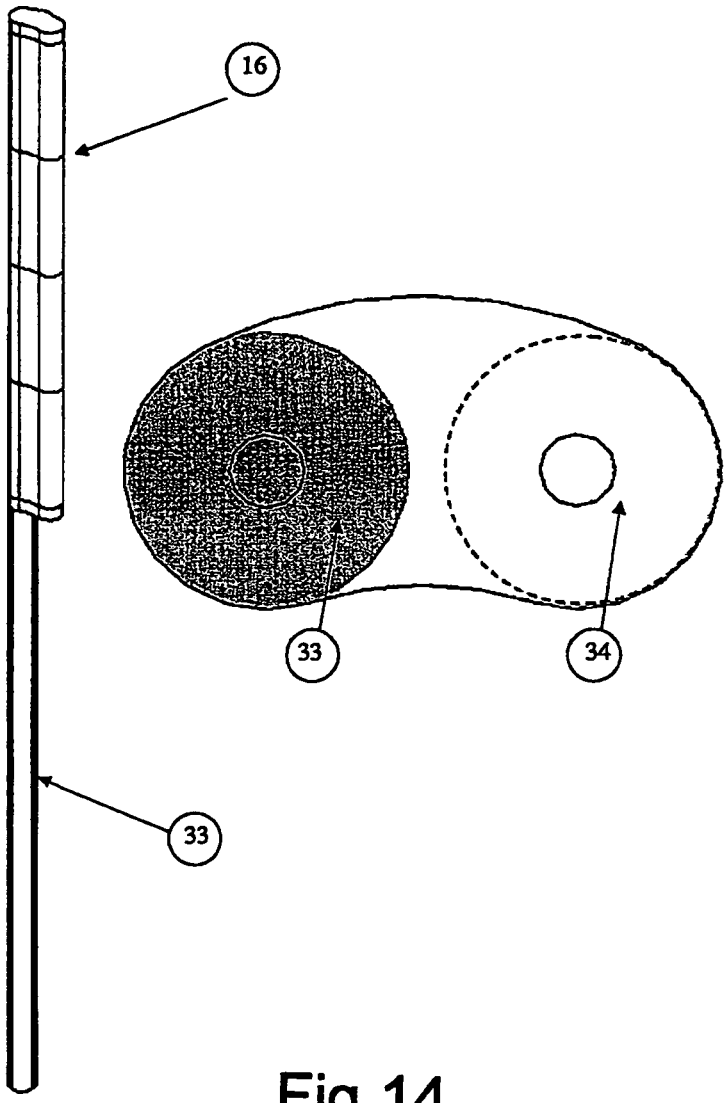
FIG. 14 illustrates the "Component Substitution or Maintenance" module.

FIG. 14 illustrates the "Component Substitution or Maintenance" module (8). This module (8) transports the components to be substituted in the well or the equipment necessary for operations on components already installed.

Possible activities are, for example, the substitution of batteries which power the sensors and the various devices on the tubing and/or on the casing or the activation of an hydraulic circuit. In this case, the module comprises two seats, the first (33) which transports the new battery to be inserted, preferably at the well bottom, the second (34) which recovers and houses the exhausted battery.

Service stations are necessary for a complete functionality of the automatic modular maintenance device, object of the present invention, which are assembled directly on the tubing during the completion phase of the well, in correspondence with the maintenance or substitution points of the sensors.

Figure 15:
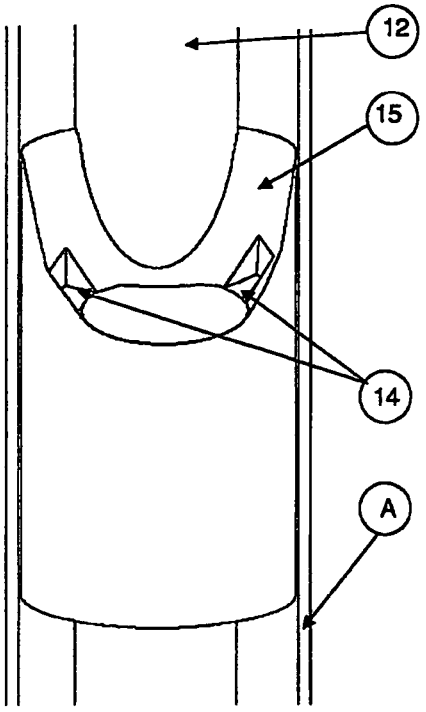
FIG. 15 illustrates a generic service station positioned on the production tubing.

FIG. 15 illustrates a generic service station positioned on the production tubing, including two recesses (14), for the insertion of the clamping mechanisms (17), and a conical surface (15) which facilitate the joining of those clamping mechanisms with the recesses. The reference (12) represents the internal surface of the tubing.

The automatic modular device, object of the present invention, is capable of operating, as previously described, in fully autonomous mode. If necessary, however, it can also be driven in a non-autonomous mode, for example it can be wire-driven in real time from the surface. In this case, the present device can also receive power by electric cable connection to the surface or by regular electric connections to electric power charging stations envisaged in the annulus and/or in the casing in specific positions.

The invention claimed is:

1. An automatic modular maintenance device that is configured to operate in an annulus of a well for the production of hydrocarbons comprising:

at least one upper head module configured to be clamped to a service station positioned on a production tubing or on a well casing;

at least one service element substitution module including a vertical housing with a space for containing a first sensor, a space for receiving a second sensor to be substituted and a space for allowing a passage of the first sensor and the second sensor to be substituted outwards;

at least one foam module including a set of elements comprised of rigid floating foam bodies that are resistant to well bottom pressure, the rigid floating foam bodies being interconnected with each other by respective connection supports;

at least one controlled thrust module including a first space occupied by compressible gas and a second space suitable for receiving completion fluid, the first space being separated from the second space by a moving sealing septum;

at least one control module including command electronics;

at least one battery module including one or more pressure resistant containers for batteries to supply power;

at least one ballast module including a ballast, a containment volume of the ballast and one or more openings for rapid release of the ballast; and a terminal component substitution or maintenance module which includes one or more spaces to contain components to be substituted in the well or equipment necessary for maintenance operations on components already installed, wherein the automatic modular maintenance device is configured to operate in a portion of the annulus excluding the production tubing in the well, wherein the modules have a substantially cylindrical portion and are connected to each other by respective articulated joints, and wherein the automatic modular maintenance device is configured to float in completion fluid present in the annulus of the well.

2. The automatic modular device according to claim 1, wherein the modules are substantially cylindrical with an essentially elliptical cross section with a larger axis of an ellipse curved so as to be substantially parallel to walls of the well.

3. The automatic modular device according to claim 1, wherein each of the modules is connected with adjacent ones by the respective articulated joints, through which power supply lines and lines for transmission of command or control signals of each module pass.

4. The automatic modular device according to claim 1, wherein a set of seats configured to house a set of sliding balls which freely rotate is provided on an outer surface of at least one of the modules.

5. The automatic modular device according to claim 1, wherein the upper head module includes a clamping mechanism activated by a motor and comprising two arms configured to be inserted in specific interfaces present in the service station.

6. The automatic modular device according to claim 1, wherein the service element substitution module includes at least first, second and third vertical stacked housings, the first vertical stacked housing allows a transportation of a new service element, and the second vertical stacked housing between the first and third vertical stacked housings allows an exchange of two service elements via an opening for a passage of the two service elements.

7. The automatic modular device according to claim 1, wherein the foam module includes two or more rigid low-density floating foam bodies made of polyurethane foam.

8. The automatic modular device according to claim 1, wherein the first space of the controlled thrust module is occupied by nitrogen.

9. The automatic modular device according to claim 1, wherein the control module comprises an electronic control board, an electronic command board and a power supply board.

10. The automatic modular device according to claim 1, wherein each of the modules has rigid low-density floating foam bodies for compensating weight of the module in the completion fluid.

11. The automatic modular device according to claim 1, wherein each of the modules has two cylinder portions.

12. The automatic modular device according to claim 1, wherein the upper head module is connected with the service element substitution module, the service element substitution module is connected with the foam module, the foam module is connected with the thrust module, the thrust module is connected with the control module, the control module is connected with the battery module, the battery module is connected with the ballast module, and the ballast module is connected with the terminal component substitution or maintenance module.

13. The automatic modular device according to claim 1, wherein the modules are configured to operate adjacent to outside of the production tubing and inside the well.

14. The automatic modular device according to claim 1, wherein the set of elements consists of the rigid floating foam bodies that are resistant to well bottom pressure.

* * * * *